US005360349A

United States Patent [19]

Provencher et al.

[11] Patent Number: 5,360,349

[45] Date of Patent: Nov. 1, 1994

[54] POWER CONNECTOR

[75] Inventors: Daniel B. Provencher, Weare, N.H.; Luciano Spiridigliozzi, Watertown, Mass.

[73] Assignee: Teradyne, Inc., Boston, Mass.

[21] Appl. No.: 40,650

[22] Filed: Mar. 31, 1993

[51] Int. Cl.[5] ..... H01R 13/698

[52] U.S. Cl. ..... 439/108

[58] Field of Search ..... 439/95, 108, 607, 609

[56] References Cited

U.S. PATENT DOCUMENTS 4,380,360 4/1983 Parmer et al. .
4,703,394 10/1987 Petit et al. .
4,755,145 7/1988 Johnson et al. .
5,046,960 9/1991 Fedder ..... 439/108
5,064,391 11/1991 Buchter .

FOREIGN PATENT DOCUMENTS 0220677 5/1987 European Pat. Off. .
1572858 8/1980 United Kingdom .

*Primary Examiner*—Eugene F. Desmond

[57] ABSTRACT

A power connector includes interfitting male and female groups, the male group including a power lead and an apertured enclosure, and the female group including a housing for receiving the male group and power receptacles.

7 Claims, 6 Drawing Sheets

POWER CONNECTOR

FIELD

This invention relates to power connectors, and more particularly to such connectors protecting against undesired human bodily contact with a power conductor.

BACKGROUND

It has been recognized that it is desirable in connectors, as are used for example to electrically connect backplanes and daughter boards in using circuit boards, to protect the fingers, for example, of a worker, against undesired contact with a power source conductor.

SUMMARY

It has now been discovered, according to the invention, that undesired contact between human body and power lead may be counteracted with simplicity and practicality by, in a power connector, standing off the lead with insulating material relieved to a dimension less than an adjacent dimension of the lead.

In the most preferred embodiment, the power connector includes a male group and a female group, the male group including a metal blade with integral pins and a plastic protector press-fitted on the blade and grooved therealong therethrough with three grooves, each of a width less than the width of the blade therealong, and the female group including centrally thereof a trifurcated receptacle formed to fit in and through the grooves and against the blade.

PREFERRED EMBODIMENT

The presently preferred embodiment is now disclosed.

DRAWINGS

Figure 1:
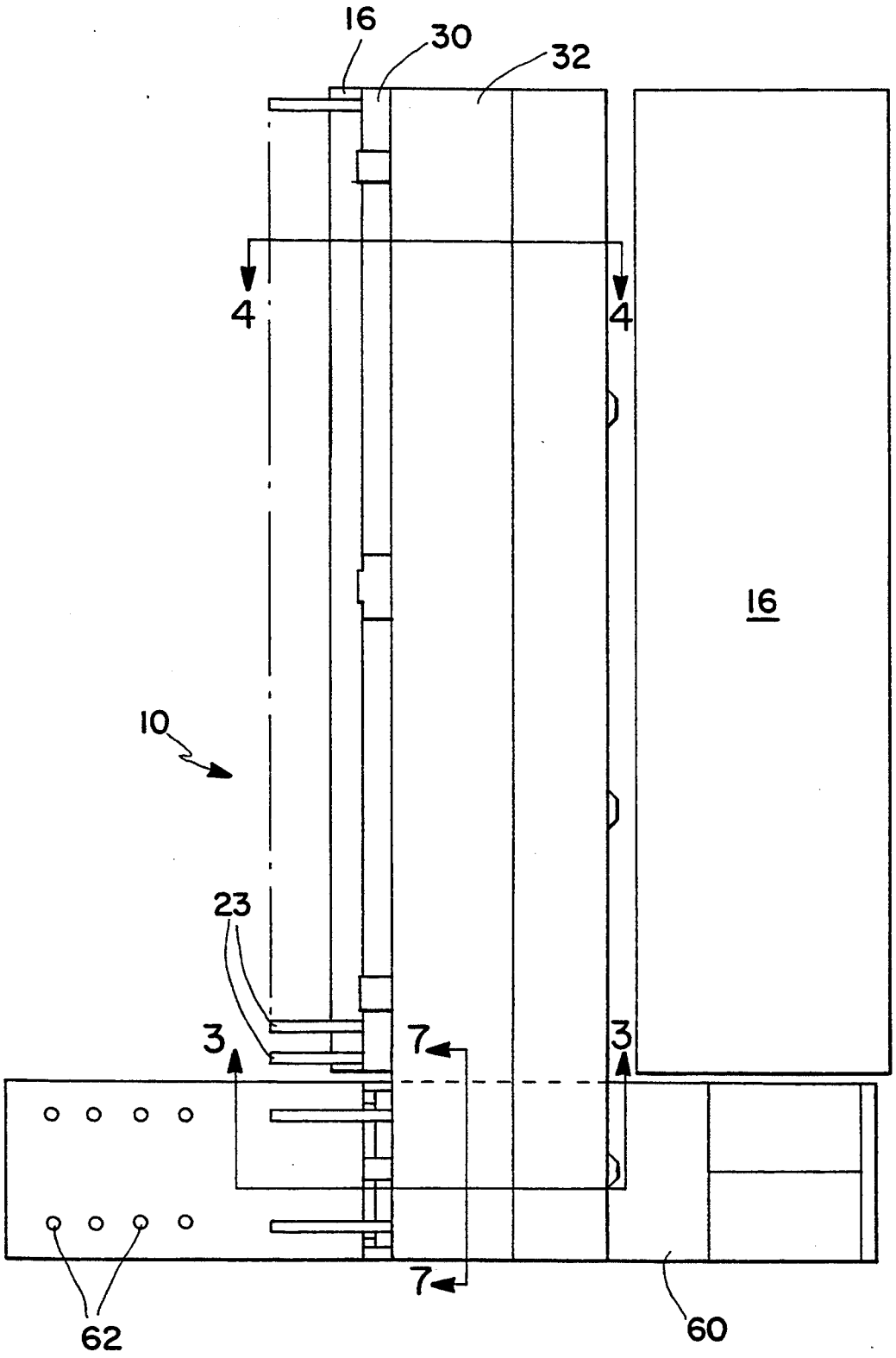
FIG. 1 is a plan view of a connector system incorporating two power connectors of the invention (one male group being shown diagrammatically, and the other three connector groups not being shown).
Figure 2:
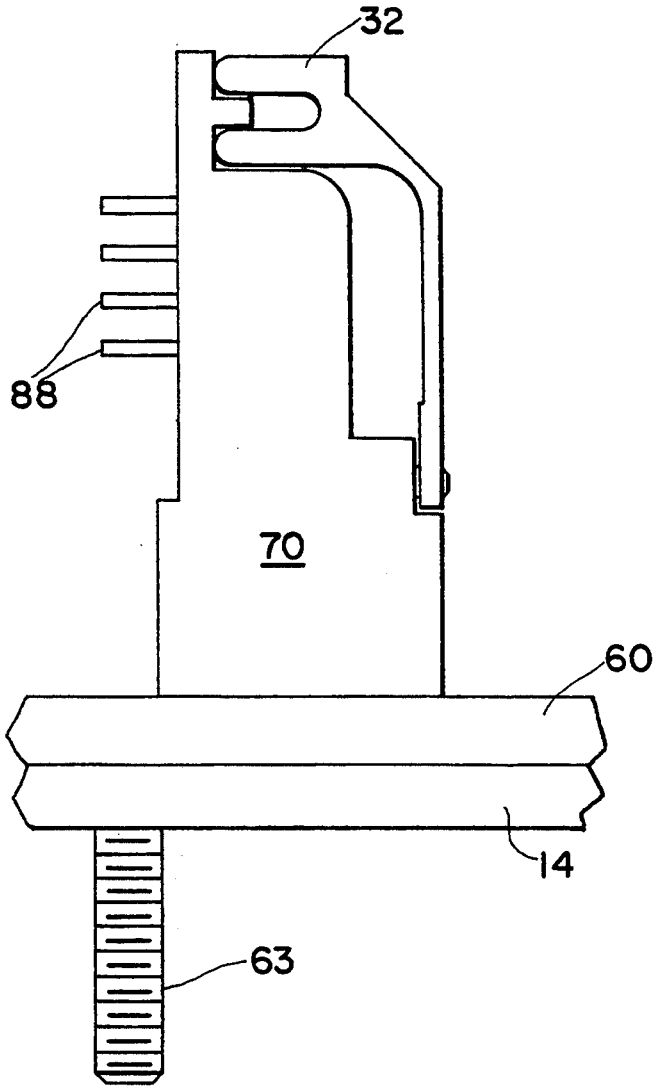
FIG. 2 is an end elevation, partially broken away, of the connector system of FIG. 1.
Figure 3:
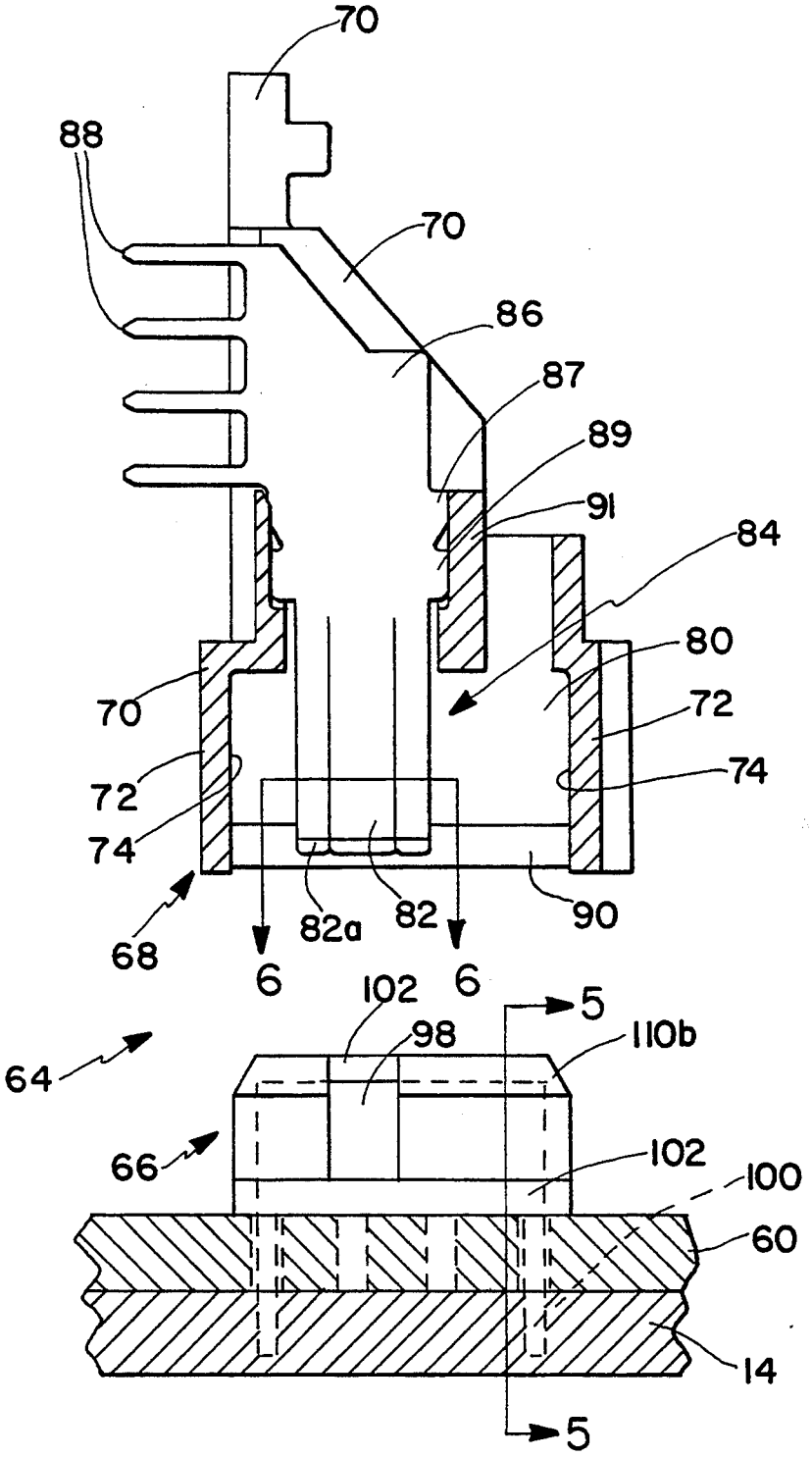
FIG. 3 is an exploded view of the preferred power connector, partially (the female group, the bus bar, and the substrate, the view of the latter two also being partial) in sectional view taken at 3—3 of FIG. 1, and partially (the male group), because of the location of the section line, in side elevation.
Figure 4:
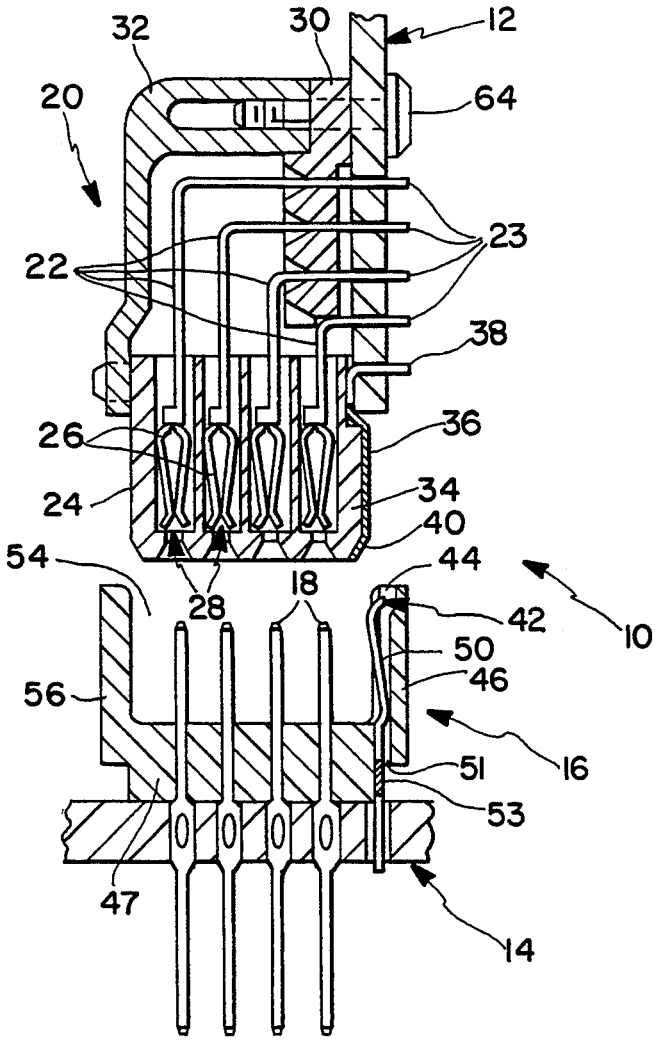

FIG. 4 is an exploded sectional view taken at 4—4 of FIG. 1, except with the orientation of daughter board connector 20, stiffener 32, and intermediate parts rotated 180° from as shown in FIGS. 1 through 3, and other slight configurational variations.

Figure 5:
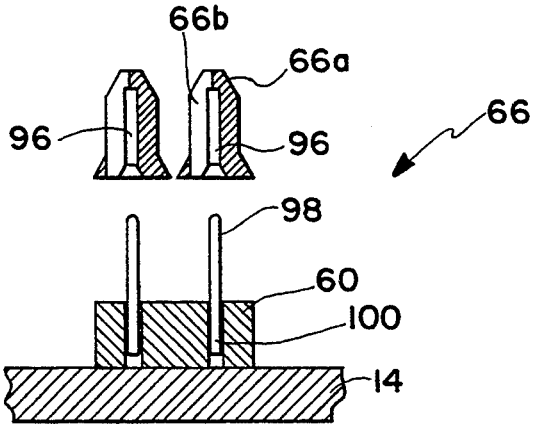

FIG. 5 is an exploded sectional view taken at 5—5 of FIG. 3.

Figure 6:
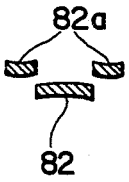

FIG. 6 is a sectional view taken at 6—6 of FIG. 3.

Figure 7:
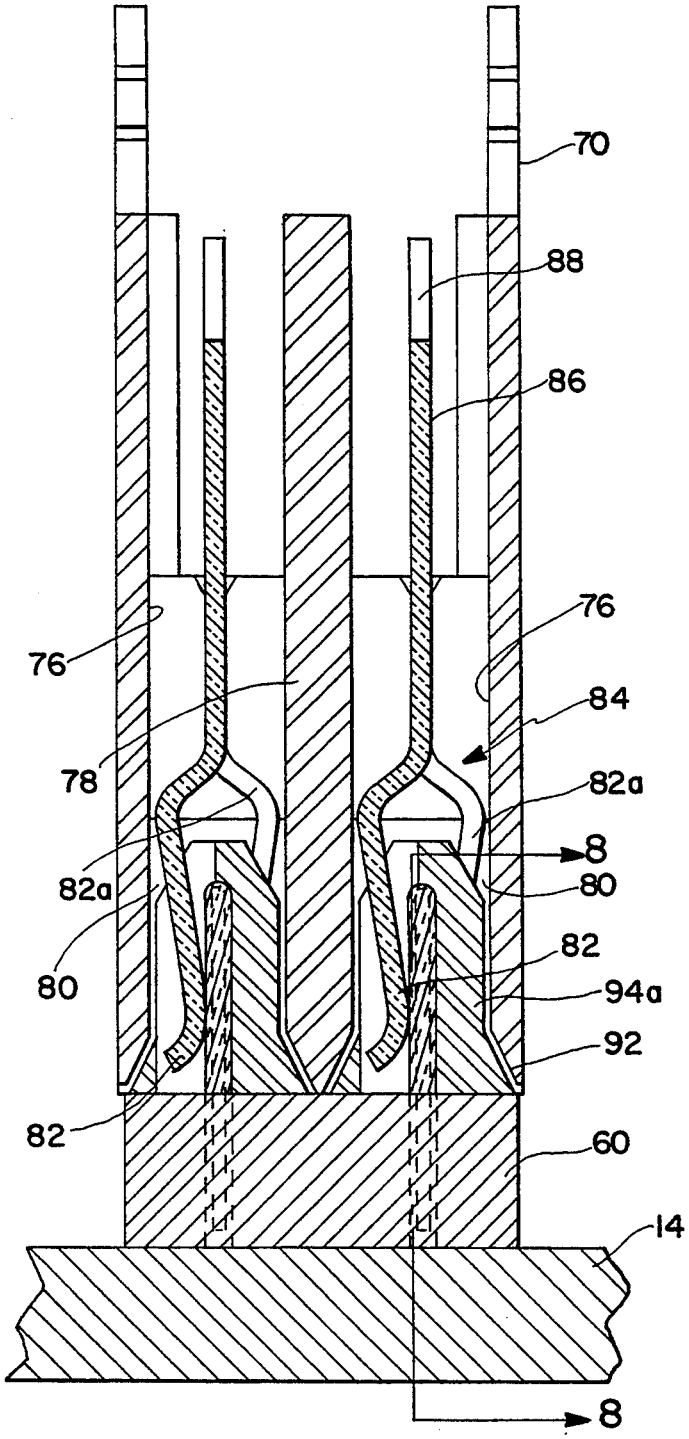

FIG. 7 is a sectional view taken at 7—7 of FIG. 1.

Figure 8:
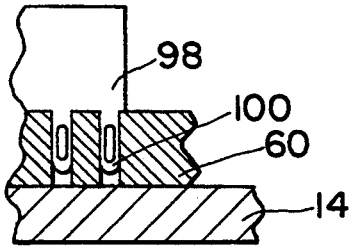

FIG. 8 is a sectional view taken at 8—8 of FIG. 7.

Figure 9:
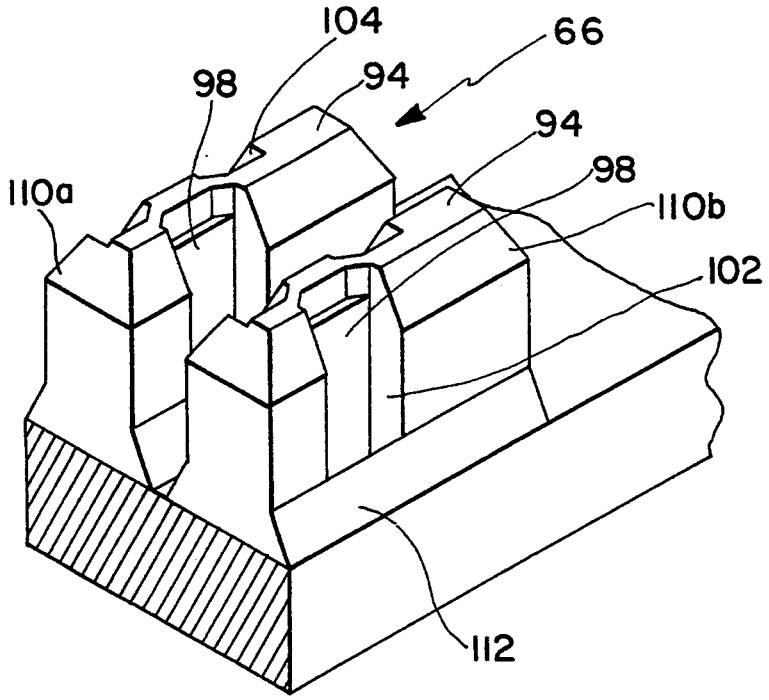

FIG. 9 is an isometric view of two male groups mounted on a bus bar.

DESCRIPTION

The structure and operation of the presently preferred embodiment are now described.

1. Structure

There is indicated generally in FIG. 1 a connector system 10 mounted between daughter board 12 (FIG. 4) and backplane or substrate 14. Also carried by backplane 14 are two backplane connector elements 16, and a daughter board connector element 20, connected over one backplane element 14, the right hand element 16 being illustrated in FIG. 1 in plan view only. Secured to backplane 14 and passing upwardly through backplane connector element 16 are four rows of signal contact pins 18 for mating with a corresponding plurality of forked signal contacts mounted in housing 24.

Signal contacts of daughter board connector element 20 are forked at lower ends 26 in boxes of plastic housing 24 and extend upwardly and are bent horizontally. The other ends 23 of contacts 22 pass through plastic guide board 30 and holes in daughter board 12, where they are soldered. Aluminum stiffener 32 is connected between guide portion 30 and housing 24 to cover exposed portions of contacts 22 and provide structure to daughter board connector element 20. On an outer face of side wall 34 of housing 24 are ground contacts 36. Contacts 36 are secured to wall 34 of housing 24 via vertical tabs, secured in place during molding of housing 24, and horizontal tabs, bent upward after molding. The lower ends of contacts 36 are inclined to provide guide surfaces 40. Laterally extending prongs 38 of contacts 36 pass through holes in daughter board 12, where they are soldered.

Signal contact pins 18 of backplane connector element 16 are press fit in backplane 14, and backplane connector element 16 has sidewall contacts 42 provided in grooves 44 of right hand sidewall 46 extending upward from base 47. Each contact 42 has three contact portions 50 that extend upward from connecting portion 53 through holes 51 to grooves 44. Adjacent to the top of base 47, contact portions 50 bend away from contact region or cavity 54 between sidewalls 46, 56. From there they bend back toward and into contact region 54, and at contact points they begin to bend back away from region 54. U.S. Pat. No. 4,655,518, granted to Johnson et al. Apr. 7, 1987 is hereby herein incorporated by reference.

Also mounted on backplane 14 is bus bar 60, of solid aluminum, which has extending through it a multiplicity of holes 62. Mounted on bus bar 60 is power connector 64 (indicated generally in FIG. 3), which includes (FIG. 3) a male group indicated generally at 66 and a female group indicated generally at 68.

Anchored by a frictionally engaged knurled flange thereon (not shown) and pressed in bus bar 60, and extending through (not shown) backplane 14, is screw 63.

Female group 68 (FIG. 3) includes a housing 70 formed integrally by injection molding of polyester. The housing 70 has a lower portion 72, inner and outer surfaces of which define in horizontal cross-section parallel rectangles; two of the inner surfaces are as at 74, and the other two are as at 76 (FIG. 7). The zone defined by walls 74, 76 is divided by integrally molded therewith wall 78, to provide two power lead contact receptacle receiving zones 80 receiving therein the leaves **82, 82*a* of receptacles indicated generally at 84. The inside lower ends 90, 92 (FIGS. 3, 7) of the walls defining housing 70** are downwardly outwardly tapered.

Receptacles 84 are contacts provided by the lower ends of power conductors 86 each of which terminates upwardly in sidewise-extending integral contact pins 88; the power conductors 86 are of copper, the body portion thereof being between contact portions 86 and contact portions 88, and integral with each thereof. Body portion 74 is secured in housing 70 by tines 87, 89 interacting with retention portion 91 of housing 70.

Each male group, indicated generally at 66 in FIGS. 3 and 5, includes two shield elements, two of which are shown in the upper part of exploded view FIG. 5, and each of which includes two portions 66*a* and 66*b*, integrally molded (as best shown in FIG. 9) of polyester. Seated in blind grooves 96 thereof are blade portions 98, integral with dynamic pin portions 100 (Johnson U.S. Pat. No. Re. 29,513, "Electrical Connection Apparatus", is hereby herein incorporated by reference) seated in bus bar 60, which is secured to backplane 14 by means not shown. Surfaces 110*a* and 110*b* (FIG. 9) of portions 66*a* and 66*b* taper upwardly inwardly; surfaces 112 thereof taper downwardly outwardly. Grooves 102, 104 allow leaves 82, 82*a* to go through them to engage blade portion 98 in each shield of male group 66, while being too narrow to permit contact with a blade portion 98 of a human finger, or with a test finger having a generally elliptical cross-section, major and minor axes of the cross-section ellipse being 2 mm and 4 mm.

Leaves 82, 82*a* and blade 98 are copper gold plated over contact areas; the design saves significantly on gold needed for this purpose.

2. Operation

In operation, a power wire (not shown) applies a power voltage to screw 63, causing current to flow therein, in bus bar 60, in blade 98, in receptacle leaves 82 and 82*a*, throughout conductor 86, including also contact pins 88, which extend (not shown) through daughter board 12, to power electrical devices carried thereby. To accomplish this, male groups 66 are introduced into female group zones 80, whereupon leaves 82, 82*a* engage blade 98, passing respectively through grooves 102, 104, to engage blade 98, leaf 82 urging blade 98 in one transverse direction, and leaves 82*a* urging blade 98 in the other.

Grooves 102, 104 are too small to permit a human finger to touch blade 98.

OTHER EMBODIMENTS

Other embodiments will occur to those skilled in the art.

The power conductor may be a plurality of conductive elements rather than a single blade. The bus bar may be omitted, and pins from the conductor blade anchored directly in the backplane. Pins to the blade may engage the substrate, simply passing through the bus bar (as in FIG. 3) or may engage the bus bar, which may be otherwise attached to the backplane (as, in FIG. 5, by means not shown). Pins may be soldered in place rather than dynamic. Housing end portions may vary in the female group of the power connector, as shown by comparing FIGS. 2 and 3.

What is claimed is:

1. A power connector comprising
a female group comprising
a power conductor and
a housing,
said power conductor including
a first contact portion, and
a second contact portion, and
a body portion therebetween,
the portions being of metal and integral, and in which
said first contact portion comprises a plurality of pins and
said second contact portion comprises a receptacle,
said housing including
a male group receptor opening and
a retention portion adapted to receive and hold said body portion.

2. The power connector of claim 1 in which said receptacle comprises a plurality of leaves, at least one of said leaves being arranged to apply to an object in said receptacle a force oppositely directed from forces adapted to be applied to said object by at least one other of said leaves.

3. The power connector of claim 2 in which said receptacle comprises three leaves in side-by-side relation, the intermediate one being of area larger than each of the two beside said intermediate one, the leaves being formed and arranged so that said intermediate one applies to an object between it and the other said two a force directed oppositely to forces exerted on said object by said other said two.

4. The power connector of claim 1 which includes also a male group,
said male group including
a power supply conductor and
a power supply conductor shield,
said power supply conductor being positioned in said shield, and
said shield being adapted to fit in said male group receptor opening and being relieved in openings through walls thereof to accommodate therethrough said contact portion for engagement thereby of said power supply conductor, said openings being of width therethrough less than the width of said power supply conductor.

5. The power connector of claim 4 in which
said power supply conductor is a blade and
said second contact portion is a receptacle.

6. The power connector of claim 5 in which said shield is an insulating member around said blade and said openings are slots therethrough.

7. The power connector of claim 6 in which are provided three said slots, two through a first wall of said shield, and one through an opposite wall of said shield, and in which said receptacle is trifurcated to provide leaves biased in opposing directions against said blade.

* * * * *